US006997128B2

(12) United States Patent
Matsuda

(10) Patent No.: US 6,997,128 B2
(45) Date of Patent: Feb. 14, 2006

(54) STAND-UP TYPE PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/803,617

(22) Filed: Mar. 17, 2004

(65) Prior Publication Data

US 2004/0194682 A1 Oct. 7, 2004

(30) Foreign Application Priority Data

Mar. 19, 2003 (JP) ..... 2003-075172

(51) Int. Cl.
*B63B 35/73* (2006.01)

(52) U.S. Cl. ..... 114/55.52; 114/55.56; 123/179.25; 440/88 A; 440/88 L; 440/89 J

(58) Field of Classification Search ..... 440/88 R, 440/88 A, 88 L, 89 R, 89 J; 114/55.5, 55.52, 114/55.56; 123/179.25
See application file for complete search history.

(56) References Cited

U.S. PATENT DOCUMENTS

| | | | | |
|---|---|---|---|---|
| RE30,978 | E * | 6/1982 | Jacobson | 114/290 |
| 5,007,870 | A * | 4/1991 | Okubo et al. | 440/89 R |
| 5,634,832 | A * | 6/1997 | Nakase et al. | 440/88 R |
| 5,699,749 | A * | 12/1997 | Yamada et al. | 114/55.51 |
| 6,183,324 | B1 * | 2/2001 | Nanami | 440/89 R |
| 6,875,069 | B2 * | 4/2005 | Araki et al. | 440/88 A |
| 2001/0042498 | A1 * | 11/2001 | Burnham | 114/55.56 |
| 2002/0104298 | A1 * | 8/2002 | Inoue et al. | 55/385.3 |

* cited by examiner

*Primary Examiner*—Sherman Basinger
(74) *Attorney, Agent, or Firm*—Alleman Hall McCoy Russell & Tuttle LLP

(57) ABSTRACT

A stand-up type personal watercraft comprises a body including a hull and a deck covering the hull from above, the body having a foot deck at a rear portion of the deck, on which an operator rides, a water jet pump configured to propel the watercraft, and a four-cycle multi-cylinder engine provided within the body and configured to drive the water jet pump, wherein the engine is disposed forward of the foot deck within the body and substantially at a center position in a longitudinal direction of the body.

12 Claims, 9 Drawing Sheets

STAND-UP TYPE PERSONAL WATERCRAFT

BACKGROUND OF THE INVENTION

1. Field of the Invention

The present invention relates to a stand-up type personal watercraft which is operated by an operator riding in a standing position on a foot deck of a rear portion of a body of the watercraft.

2. Description of the Related Art

In recent years, jet-propulsion personal watercraft have been widely used in leisure, sport, rescue activities, and the like. The personal watercraft is equipped with an engine mounted within a space surrounded by a hull and a deck. The engine is configured to drive a water jet pump, which pressurizes and accelerates water sucked from a water intake generally provided on a bottom surface of the hull and ejects it rearward from an outlet port of the water jet pump. As the resulting reaction, the personal watercraft is propelled forward.

There is a straddle-type personal watercraft operated by an operator straddling a seat mounted over an upper portion of a body of the watercraft and a stand-up type personal watercraft operated by an operator standing on a foot deck provided on a rear portion of the body. In recent years, in the straddle-type personal watercraft, the use of a four-cycle engine in place of the conventional two-cycle engine has been contemplated (Japanese Utility Model Publication No. Hei. 5-40262). And, a need for the four-cycle engine in place of the two-cycle engine also exists in the stand-up type personal watercraft. However, if the four-cycle engine is mounted in the stand-up type personal watercraft, the following problems will arise.

Since the four-cycle engine is constructed such that valve drive components such as air-intake and exhaust valves and a cam are provided above a cylinder, the four-cycle engine generally has a height larger than that of the two-cycle engine. Therefore, it is necessary to mount the four-cycle engine that is larger in size than the two-cycle engine in a space of the body of the stand-up type personal watercraft, which is smaller than that of the straddle-type personal watercraft.

Since the four-cycle engine includes the valve drive components within a cylinder head as described above and hence its center of gravity is located higher, the center of gravity of the personal watercraft equipped with the engine tends to be located higher. Since the body of the stand-up type personal watercraft has a relatively small width, the watercraft easily rolls. Therefore, it is necessary to locate the center of gravity of the components, including the engine and auxiliary devices as low as possible.

In addition to the center of gravity, attitude (balance) of the watercraft affects cruising capability. The attitude of the watercraft is determined by weight associated with the components, such as the engine and the auxiliary devices and the operator, a buoyant force, and arrangement or placement of these components and the operator.

In the stand-up type personal watercraft equipped with the two-cycle engine, since the components mounted within the body have a relatively small weight, the arrangement of the component does not substantially affect the attitude of the personal watercraft. Instead, because of the small-sized body, weight and attitude of the riding operator significantly affect the cruising attitude of the watercraft. Therefore, the two-cycle engine is typically mounted in the stand-up type personal watercraft such that it is located forward of a center position in the longitudinal direction of the body, considering the condition in which the operator rides on the foot deck provided on the rear portion of the body.

In the case of the four-cycle engine, on the other hand, since the total weight of the components mounted within the body, including the engine, is relatively large, the weight and position of the riding operator affects less than those in the case of the two-cycle engine. In other words, the center of gravity of the body containing the components is important, and it is therefore necessary to properly arrange the components so that the weight and the buoyant force are well balanced.

Within the body of the personal watercraft, an oil tank is equipped to reserve oil for lubricating the engine. Since the stand-up type watercraft is small and lightweight in contrast to the straddle-type personal watercraft, the body varies its attitude according to an operation performed by the operator. For example, during cruising, the body frequently turns at a sharp angle. When the watercraft turns at a sharp angle, a lateral great inertia force is applied to the body. In the case of a horizontally elongate oil tank used in the conventional two-cycle engine, such great inertia force causes oil contained therein to undesirably gather at one side.

In order for the watercraft to skip along the surface of choppy water, the hull of the watercraft is typically shaped such that a front portion protrudes slightly downward and an inner surface of an engine-mounted portion of the hull is inclined forwardly downward. This makes an inner bottom surface of a crankcase of the engine inclined forwardly downward. Therefore, an oil-collecting structure that collects oil reserved in a bottom portion of the crankcase is typically located at a front portion within the crankcase.

However, in the stand-up type personal watercraft, when the operator rides on the foot deck at the rear portion of the body, its fore part is located higher than its aft part. When the watercraft starts cruising, the fore part is located higher than the fore part before cruising. In this case, the inner bottom surface of the crankcase is inclined such that its front portion is located higher than its rear portion and an inertia force is generated rearward while the body is accelerating forward. Under this condition, the oil gathers in the rear portion the inner bottom portion of the crankcase. As a result, the oil is not collected efficiently from a front portion of the crankcase.

SUMMARY OF THE INVENTION

The present invention addresses the above-described condition, and an object of the present invention is to provide a stand-up type personal watercraft comprising a four-cycle engine mounted therein, which is capable of keeping weight and buoyant force properly in balance and having a lubricating system capable of properly functioning while the watercraft is cruising in an attitude peculiar to the stand-up type personal watercraft.

According to the present invention, there is provided a stand-up type personal watercraft comprising a body including a hull and a deck covering the hull from above, the body having a foot deck at a rear portion of the deck, on which an operator rides, a water jet pump configured to propel the watercraft, and a four-cycle multi-cylinder engine provided within the body and configured to drive the water jet pump, wherein the engine is disposed forward of the foot deck within the body and substantially at a center position in a longitudinal direction of the body.

The use of the multi-cylinder engine allows the four-cycle engine to have a relatively small height. Thus, the multi-cylinder four-cycle engine can be mounted in the stand-up type personal watercraft. In particular, the four-cylinder engine is suitable for use in the personal watercraft, because its power and size are compatible with the personal watercraft.

The stand-up type personal watercraft becomes more difficult to operate with an increase in distance between a center axis of a pump shaft of the water jet pump and the bottom of the watercraft. Accordingly, by mounting the multi-cylinder engine, a distance between the crankshaft and a bottom surface of the crankcase decreases, and correspondingly, a distance between the pump shaft and the bottom of the hull decreases.

The four-cycle engine is generally heavier than the two-cycle engine of equal displacement conventionally mounted in the stand-up type personal watercraft. However, by disposing the four-cycle engine near the center of the body, weight in the longitudinal direction of the body is well balanced.

The engine may be constructed such that a cylinder head is located above a crankcase, and may have an air-intake manifold and an exhaust manifold each connected to the cylinder head and extending downward to a lateral position relative to the crankcase. In this construction, since a center of gravity of a combination of the air-intake pipe, the exhaust pipe, and the engine is located lower, the center of gravity of the body is correspondingly located lower.

The stand-up type personal watercraft may further comprise an oil tank configured to reserve oil that circulates within the engine, and the oil tank may be placed on an opposite side of the exhaust manifold relative to the engine.

In this construction, the weight of the body is well balanced. More specifically, by disposing the oil tank having a relatively large weight on the opposite side of the exhaust manifold having a relatively large weight relative to the engine, the weight of the body is well balanced.

The oil tank may have a space elongated in a vertical direction of the body. Within the oil tank, the oil is inhibited from gathering at one side even when the stand-up type personal watercraft turns abruptly in an attitude peculiar to the watercraft.

The stand-up type personal watercraft may further comprise an oil-collecting structure disposed at a rear position of a bottom portion within the crankcase, and configured to collect the oil reserved in the crankcase of the engine and to deliver the oil to the oil tank. In this construction, the oil remaining in the inner bottom portion of the crankcase can be efficiently collected when the operator rides on the stand-up type personal watercraft to cause the watercraft to have an attitude with its fore part located higher than its aft part.

A deck opening may be formed on an upper portion of the body, and the engine may be constructed such that a cylinder head is located above a crankcase, and a cylinder head cover provided over the cylinder head protrudes from an opening face of the deck opening toward outside of the body. In this construction, the four-cycle engine having a relatively large height can be mounted within the body of the stand-up type personal watercraft. In addition, maintenance of a valve drive mechanism provided in the cylinder head can be easily carried out through the deck opening.

The stand-up type personal watercraft may further comprise a deck hood covering the deck opening, and the deck hood may have a concave portion upwardly recessed and opposed to an upper portion of the cylinder head cover so as to accommodate the cylinder head cover therein, with the deck hood covering the deck opening, and an air flow space located laterally relative to the concave portion to allow air taken in from outside to flow therein. In this construction, an increase in the height of the body may be inhibited when the four-cycle engine is mounted in the stand-up type personal watercraft.

The air flow space may form a water separating chamber that serves to separate water from the air taken in from outside. By utilizing an extra space of the deck hood as the water separating chamber serving to separate water from air, water or unwanted substances contained in the fresh air taken in from outside the watercraft can be removed. Further, by vertically providing a plate within the air flow space, or forming a labyrinth structure within the air flow space, the water can be effectively separated from the air.

The stand-up type personal watercraft may further comprises a crankshaft contained within the crankcase of the engine, a starter gear mounted on the crankshaft and configured to rotate integrally with the crankshaft by an output of a starter motor for starting the engine, and an oil pump configured to deliver oil that circulates within the engine, the oil pump being provided with a pump gear for driving the oil pump, wherein the pump gear of the oil pump is configured to mesh with the starter gear.

Conventionally, the crankshaft of the engine mounted in the watercraft is provided with a crankshaft side pump gear (sprocket) separate from the starter gear so as to rotate integrally with the crankshaft, and the oil pump is provided with a pump side pump gear (sprocket) such that these pump gears are connected to each other through a chain. However, in the above-described construction, the crankshaft side pump gear and the chain are omitted. As a result, a lightweight and small-sized engine is achieved.

The stand-up type personal watercraft may further comprise a muffler provided in an exhaust passage of the engine, and an air cleaner box provided in an air-intake passage of the engine, and the muffler and the air cleaner box may be arranged substantially forward and rearward relative to the engine.

The muffler and the air-cleaner box having relatively large inner spaces may generate a buoyant force. In the above construction, buoyant forces generated in front and rear parts of the body are well balanced.

The stand-up type personal watercraft may further comprise a plurality of mufflers provided in an exhaust passage of the engine, and the mufflers may be arranged forward and rearward relative to the engine within the body. In this construction, also, the buoyant forces generated in the front and rear parts of the body are well balanced.

The stand-up type personal watercraft may further comprise two mufflers provided in an exhaust passage of the engine, and deck fins may be provided at right and left side portions of the deck so as to protrude upward from an upper surface of the foot deck, and the mufflers may be contained in the right and left deck fins, respectively. In this construction, buoyant forces generated in right and left parts of the body are well balanced, and a limited space of the stand-up type personal watercraft can be efficiently utilized.

The above and further objects and features of the invention will more fully be apparent from the following detailed description with accompanying drawings.

DETAILED DESCRIPTION OF THE PREFERRED EMBODIMENTS

Hereinafter, a personal watercraft according to an embodiment of the present invention will be described with reference to the accompanying drawings.

Figure 1:
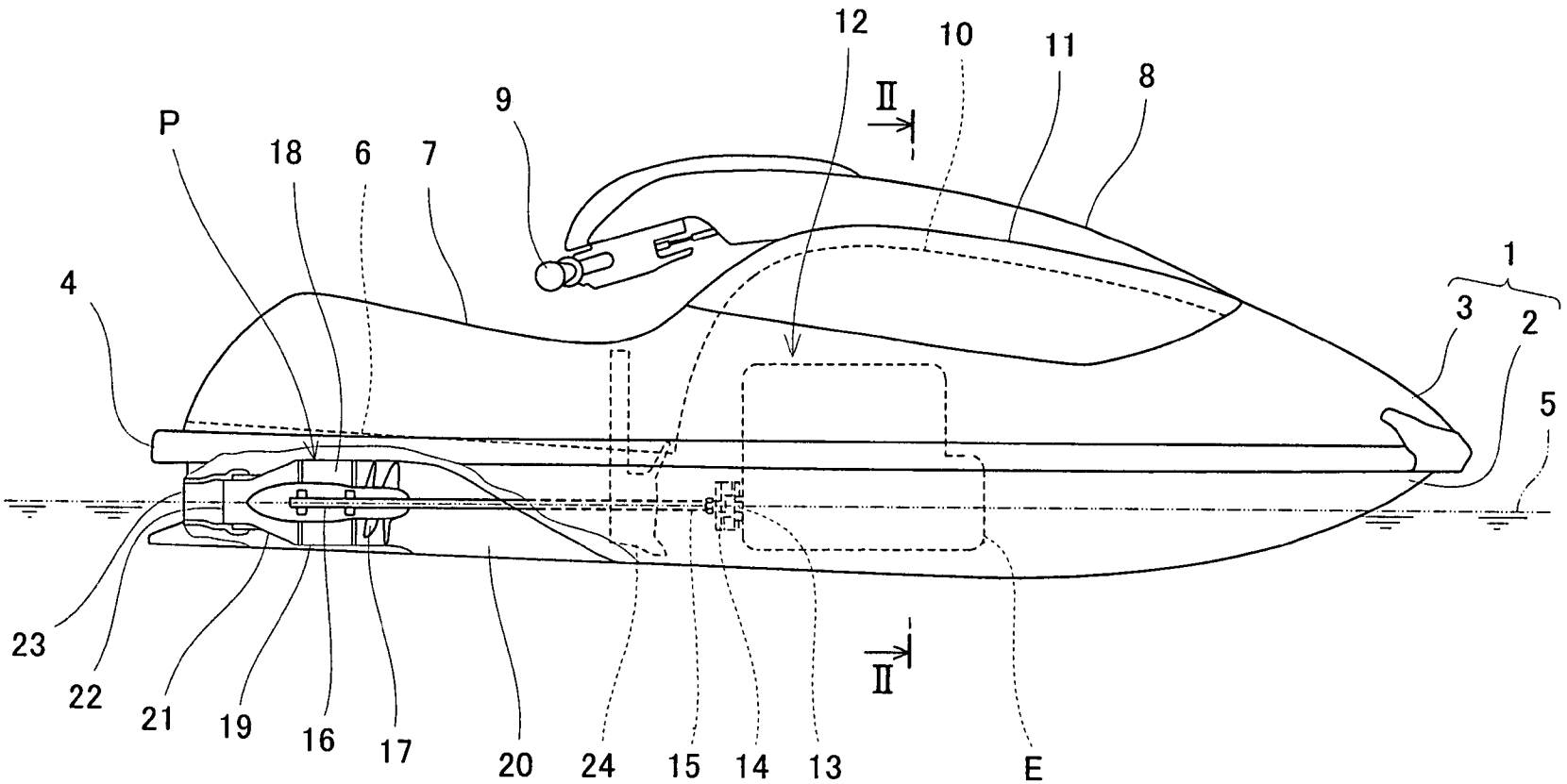
FIG. 1 is a side view of a personal watercraft according to an embodiment of the present invention.

A personal watercraft in FIG. 1 is a stand-up type personal watercraft. A body 1 comprises a hull 2 and a deck 3 covering the hull 2 from above. A line at which the hull 3 and the deck 4 are connected over the entire perimeter thereof is called a gunnel line 4. In FIG. 1, reference numeral 5 denotes a waterline under the condition in which the personal watercraft is at rest on water.

The deck 3 has a flat foot deck 6 extending from a vicinity of the center in the longitudinal direction of the body 1 to a rear end thereof. An operator rides on the watercraft in a standing or kneeling position on the foot deck 6. Deck fins 7 are respectively provided on right and left ends of the foot deck 6 so as to protrude upward from an upper surface of the foot deck 6. In FIG. 1, only the right-side deck fin is shown. Each of the deck fins 7 extends in parallel with the foot deck 6 from the vicinity of the center in the longitudinal direction of the body 1 to the rear end.

A steering column (handle pole) 8 has a front end portion pivotally supported on a front portion of the deck 3. A rear end portion of the steering column 8 is vertically pivotable. A steering handle 9 is attached to the rear end portion of the steering column 8.

The deck 3 has a deck opening 10 extending forward from the vicinity of the center in the longitudinal direction of the body 1 to allow inside and outside of the body 1 to communicate with each other. A deck hood (engine hood) 11 is removably attached to open and close the deck opening 10. An engine room 12 is formed inside of the body 1 and located forward of the foot deck 6 and below the deck opening 10. An engine E is mounted in the engine room 12.

The engine E is constructed such that a crankshaft 13 extends along the longitudinal direction of the body 1 substantially at the center position in the longitudinal direction of the body 1, preferably at a slightly forward position. In this embodiment, a rear end of the engine E is located slightly rearward relative to a middle position of the total length of the body 1. In this embodiment, the engine E is a four-cycle inline four-cylinder engine.

A rear end of the crankshaft 13 is rotatably coupled integrally with a pump shaft 16 of a water jet pump P provided on the rear side of the body 1 through a propeller shaft 15. An impeller 17 is attached on the pump shaft 16 of the water jet pump P. Fairing vanes 18 are provided behind the impeller 17. The impeller 17 is covered with a pump casing 19 on the outer periphery thereof.

A water intake 20 is provided on the bottom of the body 1. The water intake 20 is connected to the pump casing 19 through a water passage. The pump casing 19 is connected to a pump nozzle 21 provided on the rear side of the body 1. The pump nozzle 21 has a cross-sectional area that gradually reduces rearward, and an outlet port 22 is provided on the rear end of the pump nozzle 21.

Water outside the watercraft is sucked from the water intake 20 and fed to the water jet pump P. The water jet pump P pressurizes and accelerates the water, and the fairing vanes 18 guide water flow behind the impeller 17. The water is ejected through the pump nozzle 21 and from the outlet port 22 and, as the resulting reaction, the watercraft obtains a propulsion force.

A tubular steering nozzle 23 is provided behind the pump nozzle 21. The steering nozzle 23 is connected to a steering handle 9 through a cable (not shown). When the operator rotates the handle 9 clockwise or counterclockwise, the steering nozzle 23 is swung toward the opposite direction so that the ejection direction of the water being ejected through the pump nozzle 21 can be changed, and the watercraft can be correspondingly turned to any desired direction while the water jet pump P is generating the propulsion force.

In the interior of the body 1, a bulkhead 24 is provided in the vicinity of the front portion of the foot deck 6 to define a front part and a rear part of the body 1. An inner space located forward of the bulkhead 24 is an engine room 12.

Figure 2:
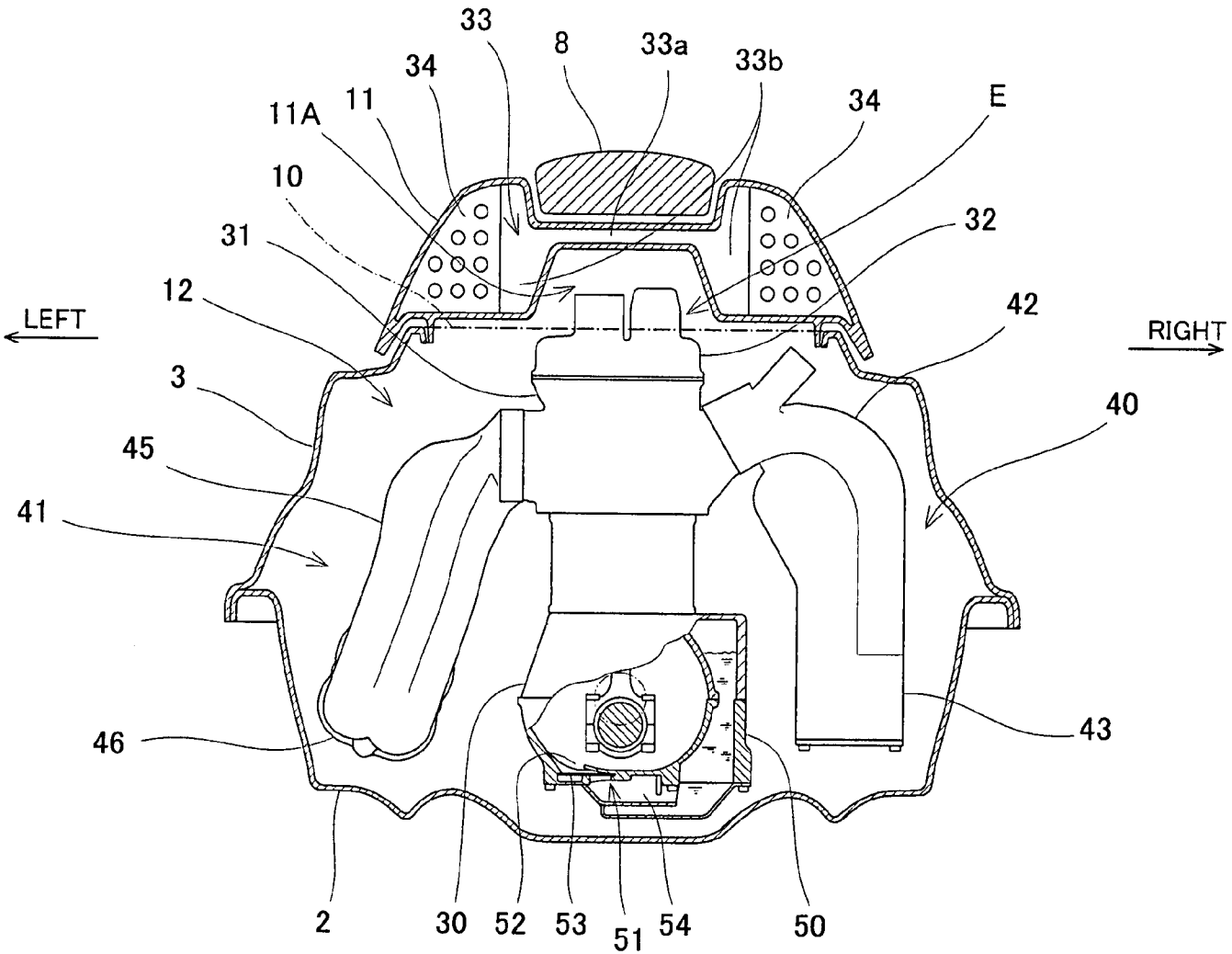
FIG. 2 is a partial cross-sectional view taken along line II—II in FIG. 1, showing an engine mounted within a body of the personal watercraft in FIG. 1, the main components of the engine being shown partly in cross-section.

As shown in FIG. 2, the engine E is located substantially at the center position in the lateral direction within the engine room 12. The engine E is constructed such that a cylinder head 31 is provided above the crankcase 30. A cylinder head cover 32 is provided over the cylinder head 31 and is configured to protrude upward from an opening face of the deck opening 10.

The deck hood 11 covering the deck opening 10 has an air flow space 33 extending along the longitudinal direction of the deck hood 11 to allow air from outside to be guided to the engine room 12. With the deck hood 11 covering the deck opening 10, the deck hood 11 has a concave portion 11A at a center portion of an inner portion (or lower portion) of the hood deck 11 such that the concave portion 11A is upwardly recessed as seen from the side of the engine E and opposed to the cylinder head cover 32 of the engine E. In this state, there is an appropriate gap between the cylinder head cover 32 protruding from the opening face of the deck opening 10 and the deck hood 11, thus avoiding interference between them. In this structure, even the four-cycle engine having a relatively large height can be mounted within the engine room 12. And, a center portion of an outer portion (upper portion) of the deck hood 11 in the lateral direction is recessed along the longitudinal direction of the body 1. The steering column 8 is contained in and fitted to this concave portion when the watercraft is at rest on the water.

By recessing a part of the deck hood 11, a first space 33*a* having a relatively small flow cross-sectional area and right and left second spaces 33*b* having relatively large flow cross-sectional areas between which the first space 33*a* is located, are formed in the air flow space 33. The right and left second spaces 33*b* communicate with each other through the first space 33*a*. Within the second spaces 33*b*, punching metals (plates) 34 provided with a plurality of penetrating holes are vertically provided so as to cross the flow direction of air. The air flow space 33 forms a water separating chamber to separate water mist from air.

Within the air space 33, the water mist is separated from the air on the punching metals 34. The provision of the punching metals 34 can improve rigidity of the deck hood 33 on which the steering column 8 is placed.

Figure 3:
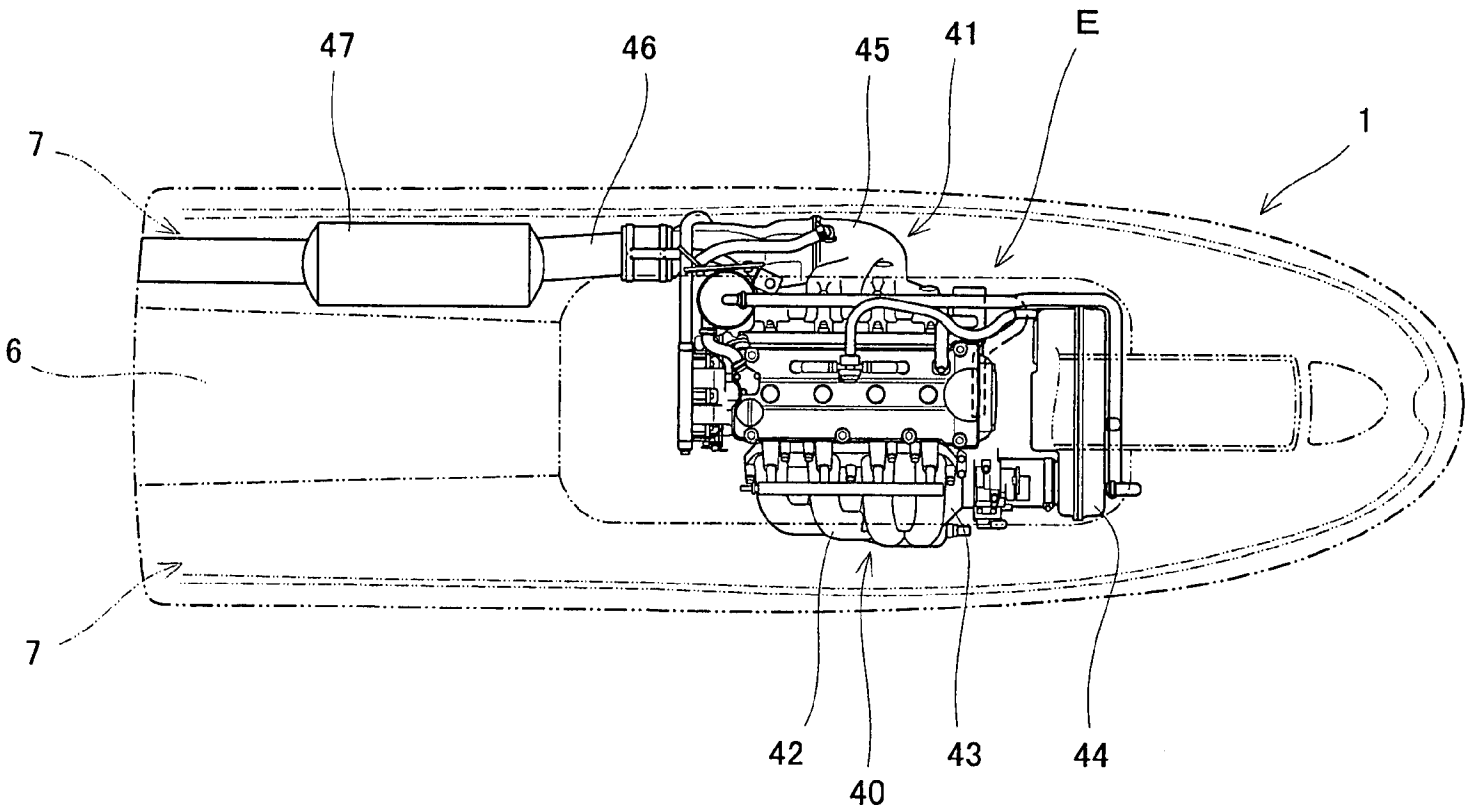
FIG. 3 is a plan view showing arrangement of auxiliary devices such as an air cleaner box, a muffler, and the like of the personal watercraft in FIG. 1, with a shape of the body indicated by two-dotted line.

As shown in FIGS. 2 and 3, an air-intake passage 40 and an exhaust passage 41 are connected to the cylinder head 31 of the engine E. As shown in FIG. 2, the air-intake passage 40 is comprised of an air-intake manifold 42, an air-intake chamber 43, and the like. The air-intake manifold 42 extends downward from a right-side portion of the cylinder head 31 and is connected to the air-intake chamber 43 located laterally relative to the crankcase 30. As shown in FIG. 3, an air cleaner box 44 is provided forward of the engine E and the air-intake chamber 43 is connected to the air cleaner box 44 through a pipe.

As shown in FIGS. 2 and 3, the exhaust passage 41 is comprised of an exhaust manifold 45, an exhaust pipe 46, and a muffler (herein, water muffler) 47. As shown in FIG. 2, the exhaust manifold 45 extends downward from a left-side portion of the cylinder head 31 to a lateral position relative to the crankcase 30. As shown in FIG. 3, the exhaust manifold 45 further extends rearward and is connected through the exhaust pipe 46 to the muffler 47 placed behind the engine E, more specifically contained within the left-side deck fin 7. The air cleaner box 44 and the muffler 47 are symmetrically provided forward and rearward relative to the engine E.

As shown in FIG. 2, the crankcase 30 of the engine E is provided with an oil tank 50 extending from a right-side portion (side portion on the opposite side of the exhaust passage 41 relative to the engine E) to a bottom portion. Within the oil tank 50, oil is reserved. Specifically, the right-side portion and the bottom portion of the crankcase 30 have a double-walled structure to form the oil tank 50. The oil is reserved within a space of the double-walled structure. The oil tank 50 is, as shown in FIG. 2, substantially inverted-L shaped when the watercraft is seen in a rear view. The oil tank 5 has a right-side inner space elongated in the vertical direction of the body 1.

Figure 4:
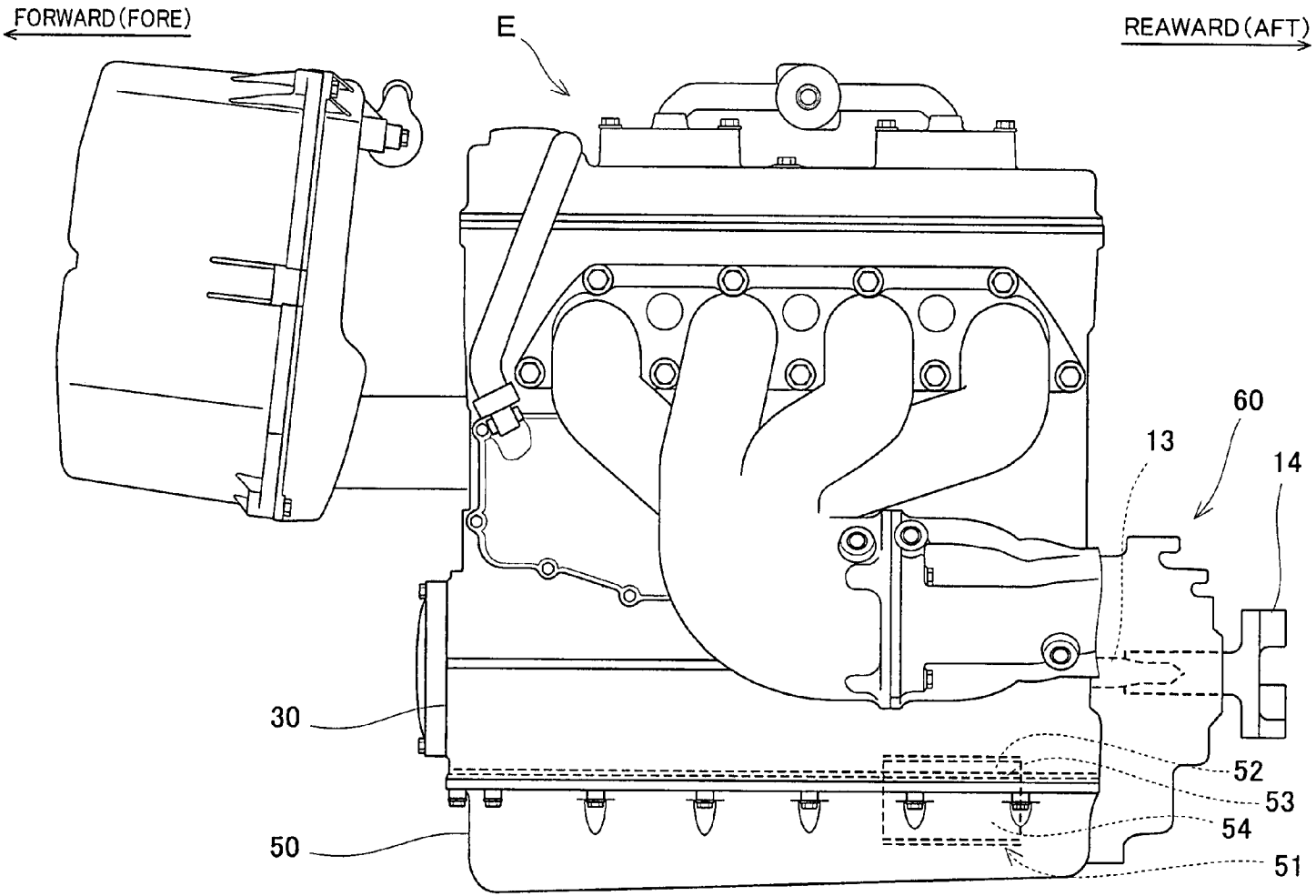
FIG. 4 is a side view of the engine mounted in the personal watercraft in FIG. 1.

As shown in FIGS. 2 and 4, an oil-collecting structure 51 is provided at a rear position in an inner bottom portion of the crankcase 30. The oil-collecting structure 51 is comprised of an oil suction port 52, a net-shaped filter 53 covering the oil suction port 52, an expansion chamber 54 provided outside the filter 53, i.e. on the oil tank 50 side, a lead valve (not shown) that is activated by a pressure within the crankcase 30, and the like. Some of the oil that has lubricated and cooled various components of the engine E is collected at the inner bottom portion of the crankcase 30, and is then collected into the oil tank 50 by the oil-collecting structure 51 by a positive pressure generated within the crankcase 30.

Figure 5:
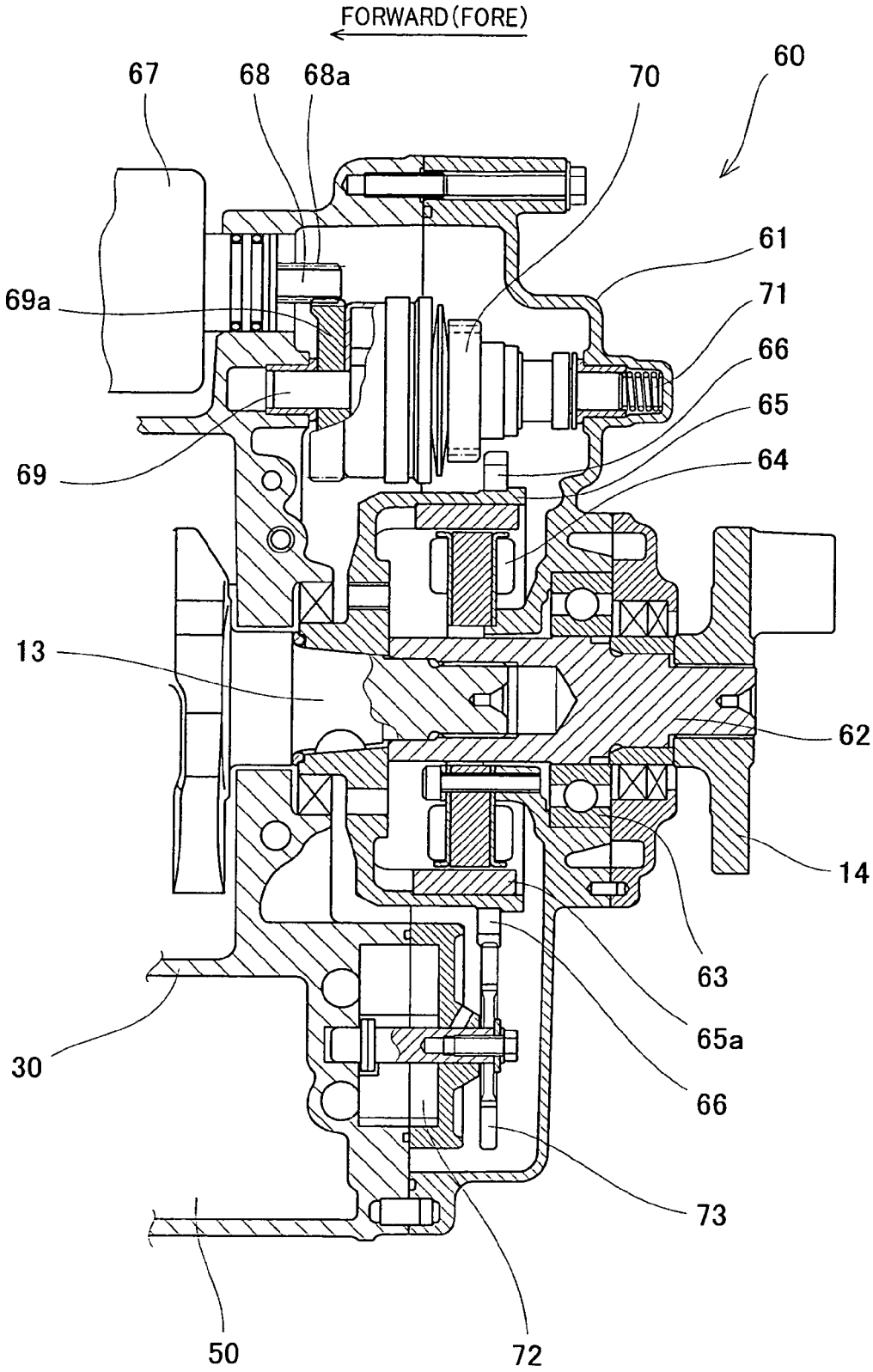
FIG. 5 is a side cross-sectional view of a gear unit of the engine mounted in the personal watercraft in FIG. 1.

As shown in FIG. 4, a gear unit 60 is provided at a rear portion of the engine E so as to enclose a rear end portion of the crankshaft 13. As shown in FIG. 5 in cross-section of the gear unit 60 in FIG. 4, the gear unit 60 is contained within a casing 61. An extended member 62 is connected to a rear end of the crankshaft 13 and extends rearward to penetrate a substantially center portion of the casing 61. The extended member 62 is supported by the casing 61 by a bearing 63, and a coupling member 14 is connected to a rear end of the extended member 62 that protrudes rearward.

An annular stator 64 is fixed to the casing 61 such that the stator 64 is externally attached to be spaced apart from an outer periphery of the extended member 62. A rotor 65 having a magnet 65*a* on an inner surface thereof is mounted to the rear end portion of the crankshaft 13 concentrically with the crankshaft 13 in such a manner that an inner periphery of the magnet 65*a* is opposed to an outer periphery of the stator 64. The rotor 65 is tubular with a bottom and an open end. A starter gear 66 for starter is formed on an outer peripheral face of the rotor 65. The starter gear 66 is comprised of a spur gear with a number of gears circumferentially arranged. The stator 64 and the rotor 65 form a generator, and when the rotor 65 rotates around the stator 64, electric power is generated.

A starter motor 67 is provided above the crankshaft 13 so as to extend in parallel with the crankshaft 13. An intermediate shaft 69 is provided between the starter motor 67 and the crankshaft 13 so as to extend in parallel with the crankshaft 13. A rotational force of a rotor shaft 68 of the starter motor 67 is transmitted from a pinion 68*a* formed at a rear end of the rotor shaft 68 to a first intermediate gear 69*a* mounted on the intermediate shaft 69 so as to rotate integrally with the intermediate shaft 69. The intermediate shaft 69 is supported at a front end portion by the crankcase 30 and at a rear end portion by the casing 61.

A second intermediate gear 70 is mounted concentrically on the intermediate shaft 69 so as to be rotatable integrally with and axially slidable on the intermediate shaft 69. The second intermediate gear 70 is configured to mesh with the starter gear 66 which is mounted on the outer periphery of the rotor 65. More specifically, when the starter motor 67 is activated, the second intermediate gear 70 moves rearward, and is brought into mesh with the starter gear 66. Under this condition, the rotational force of the rotor shaft 68 of the starter motor 67 is transmitted to the crankshaft 13 through the second intermediate gear 70 and the starter gear 66.

A pump gear 73 is provided under the crankshaft 13 to drive an oil pump 72. The pump gear 73 is placed such that its center axis is parallel to the crankshaft 13. The pump gear 73 is also configured to mesh with the starter gear 66. With the pump gear 73 in mesh with the starter gear 66, the rotational force of the crankshaft 13 is transmitted to the pump gear 73 through the starter gear 66, and drives the oil pump 72.

With reference to FIGS. 6 to 9, another embodiment having a construction with a different arrangement of the auxiliary devices (e.g., air cleaner box, muffler) from that shown in FIG. 3, will be described.

Figure 6:
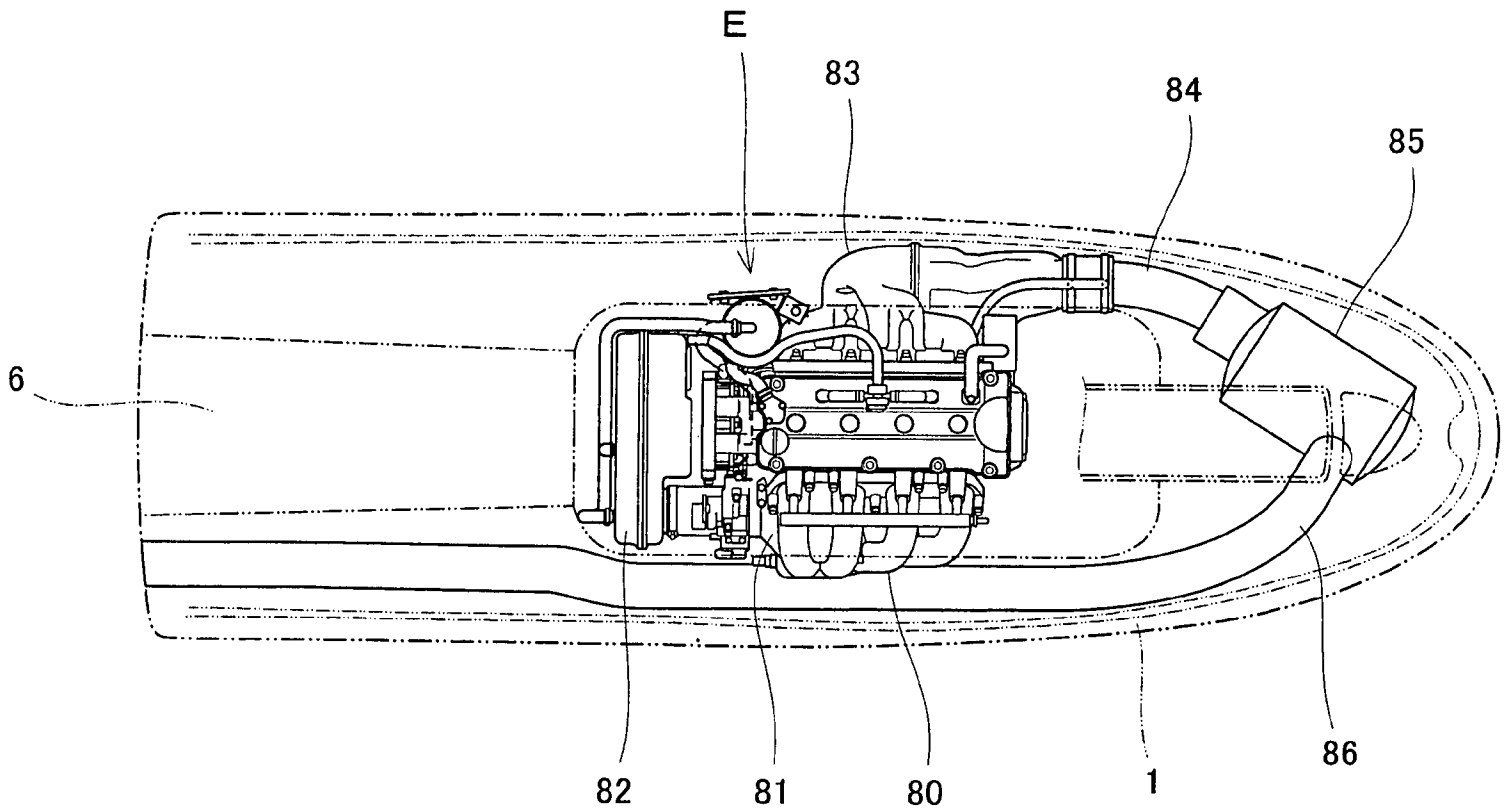
FIG. 6 is a plan view showing another arrangement of the auxiliary devices applicable to the personal watercraft in FIG. 1.

In the personal watercraft in FIG. 6, an air-intake manifold 80 extends from the right-side portion of the engine E and is connected to an air cleaner box 82 placed behind the engine E through an air-intake chamber 81. An exhaust manifold 83 extends from the left-side portion of the engine E and is connected through a first exhaust pipe 84 to a muffler 85 located forward of the engine E and directed obliquely forward. A second exhaust pipe 86 is connected to the muffler 85. The second exhaust pipe 86 extends rearward through a right end within the body 1 of the watercraft and communicates with outside the watercraft at an aft part of the body 1.

In the personal watercraft constructed as described above, the air cleaner box 82 and the muffler 85 are symmetrically provided forward and rearward relative to the engine E, respectively. In this case, the buoyant forces generated in the front and rear parts of the body 1 are properly in balance.

Figure 7:
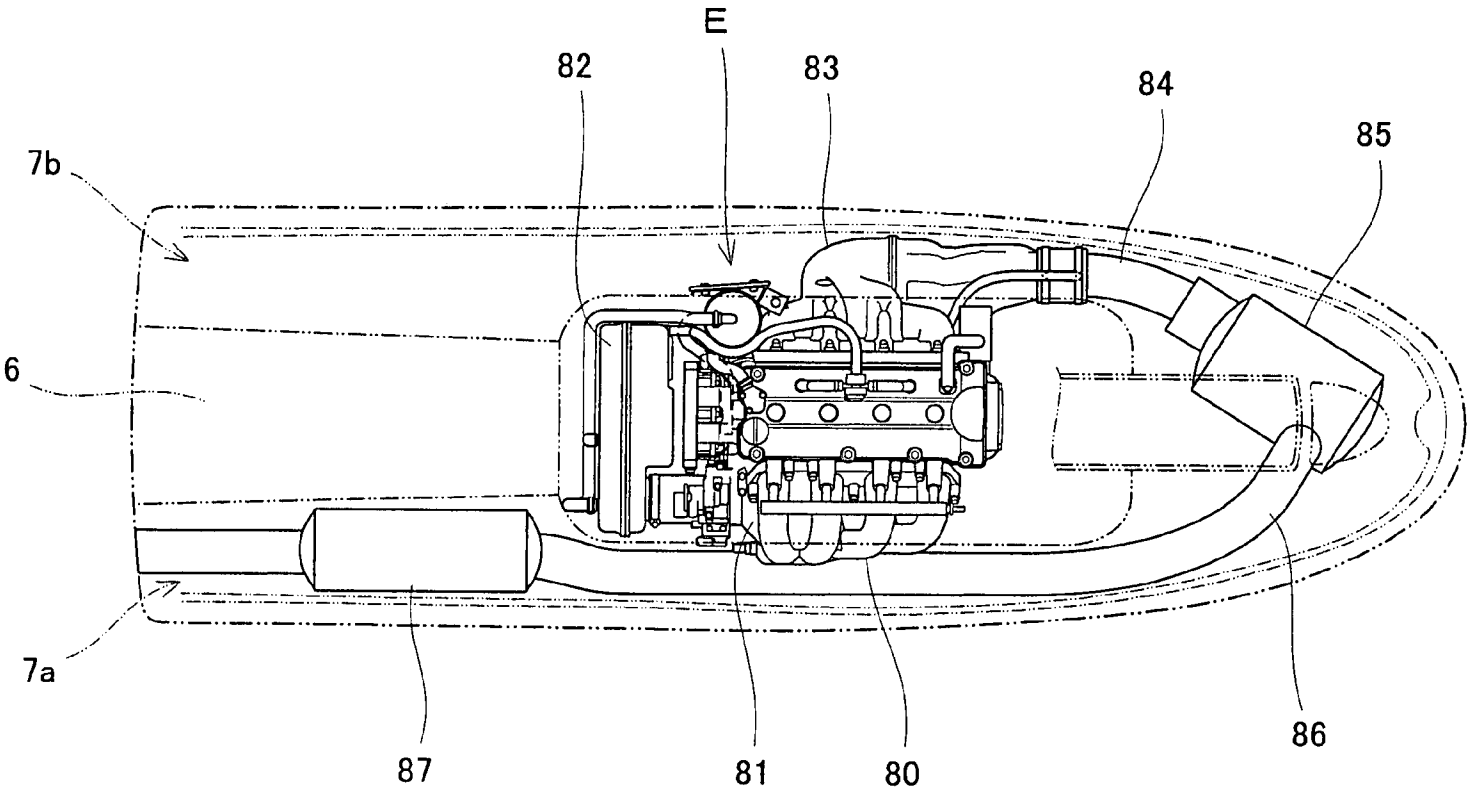
FIG. 7 is a plan view showing another arrangement of the auxiliary devices applicable to the personal watercraft in FIG. 1, which is different from those shown in FIGS. 3 and 6.

In the personal watercraft in FIG. 7, the air-intake manifold 80, the air-intake chamber 81, the air-intake box 82, the exhaust manifold 83, the first exhaust pipe 84, and the muffler (first muffler) 85 are arranged as in the personal watercraft in FIG. 6. It should be appreciated that in the personal watercraft in FIG. 7, another muffler (second muffler) 87 is provided within a right-side deck fin 7*a* at a position of the second exhaust pipe 86 in FIG. 6.

In the manner described above, in the stand-up type personal watercraft having a limited space, the second muffler 87 is placed in a space within the deck fin 7*a* to further muffle a noise. The second muffler 87 can generate a buoyant force against the gravity of the operator riding on the watercraft.

Figure 8:
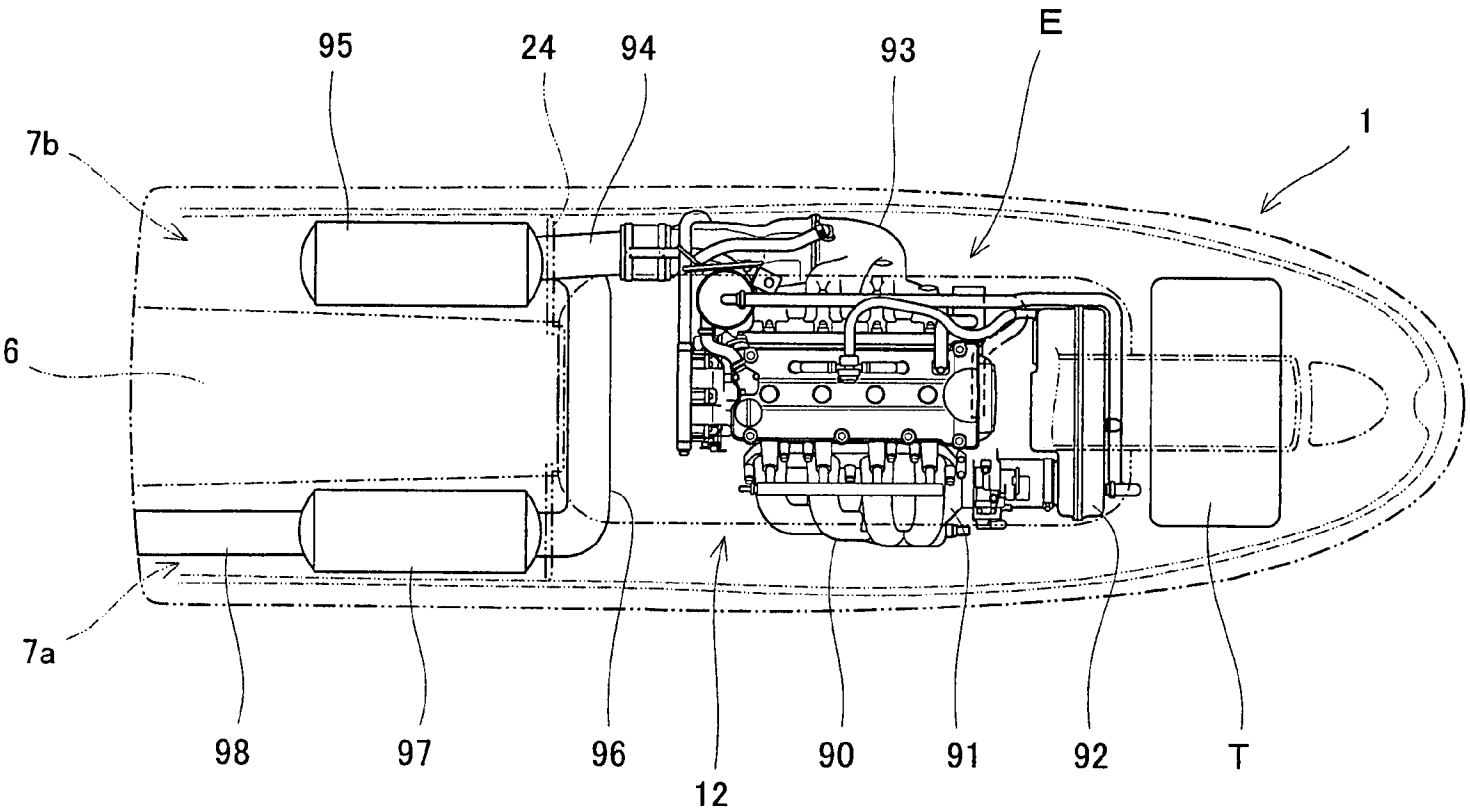
FIG. 8 is a plan view showing another arrangement of the auxiliary devices applicable to the personal watercraft in FIG. 1, which is different from those shown in FIGS. 3, 6 and 7.
Figure 9:
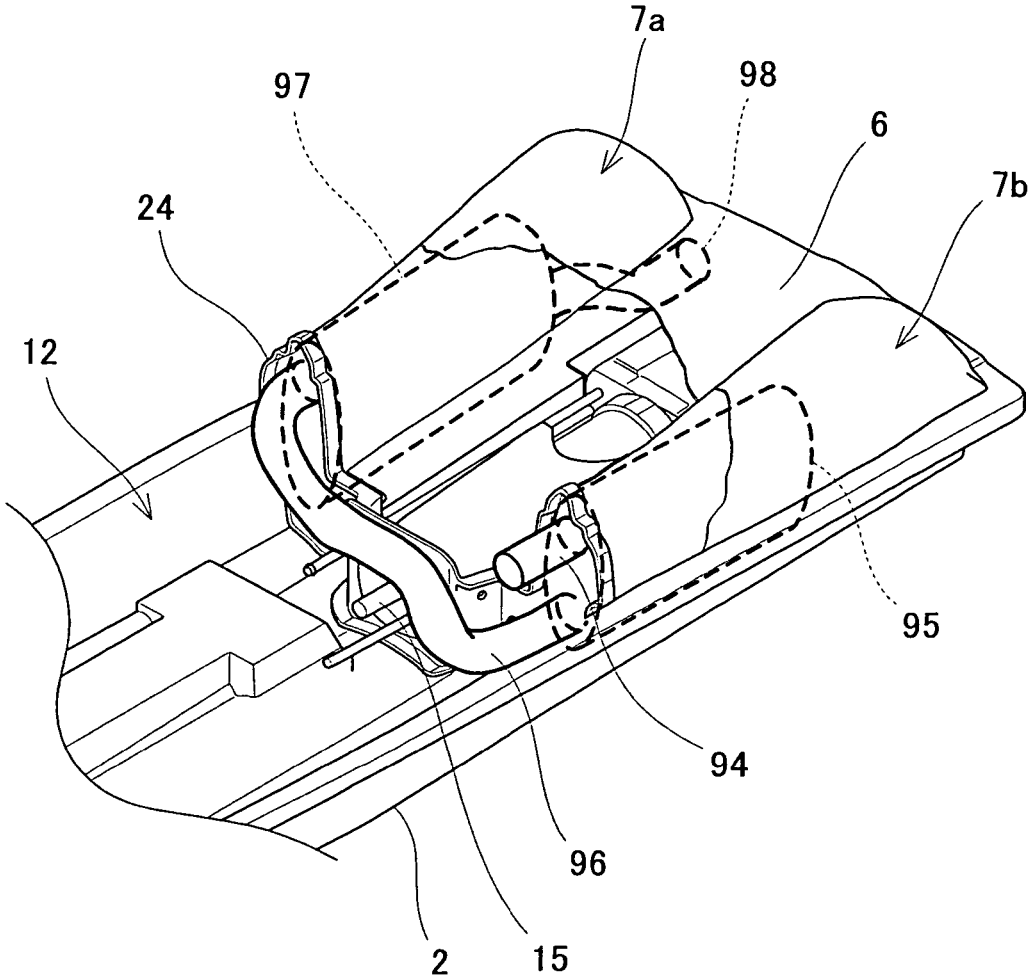
FIG. 9 is a perspective view showing arrangement of the auxiliary devices in FIG. 8.

In the personal watercraft in FIG. 8, as in the watercraft in FIG. 3, an air-intake manifold 90 extends from the right-side portion of the engine E, and is connected through an air-intake chamber 91 to an air-intake box 92 placed in front of the engine E. An exhaust manifold 93 extends from the left-side portion of the engine E, and a first exhaust pipe 94 is connected to a rear end portion of the exhaust manifold 93. As shown in FIGS. 8 and 9, the first exhaust pipe 94 extends through the bulkhead 24 from the side of the engine room 12, and is connected to an upper position of a front portion of a first muffler 95 contained behind the engine E, more specifically, within the left-side deck fin 7*b*.

A second exhaust pipe 96 extends forward from a lower position of the front portion of the first muffler 95 through the bulkhead 24. Then, the second exhaust pipe 96 traverses within the engine room 12 to the right and along the bulkhead 24 over the propeller shaft 15. Further, the second exhaust pipe 96 extends rearward through the bulkhead 24 and is connected to an upper position of the front portion of a second muffler 97 contained in the right-side deck fin 7*a*. Moreover, a third exhaust pipe 98 extends rearward from a lower position of a rear portion of the second muffler 97 and communicates with outside the body 1 at the aft part.

In the watercraft constructed as described above, the buoyant forces generated in the right and left parts of the rear portion (foot deck 6) of the personal watercraft on which the operator rides are well balanced, and the second muffler 97 can be disposed in a small inner space of the body 1 of the stand-up type personal watercraft.

Recently, with development of a high-displacement engine, the demand for a large-volume fuel tank and a large-volume muffler has been increasing. With the above construction, a large-volume muffler can be contained in spaces with the deck fins 7*a* and 7*b*, and the large-volume fuel tank T can be placed in the front portion of the body 1.

The first muffler 95 and the second muffler 97 are water mufflers. Since an inlet of an exhaust gas is provided at the upper position and an outlet of the exhaust gas is provided at the lower position in each of the mufflers 95 and 97 as described above, water remaining within the mufflers 95 and 97 is discharged outside the watercraft by a flow of the exhaust gas. Thus, it is possible to inhibit reduction of the buoyant force.

As this invention may be embodied in several forms without departing from the spirit of essential characteristics thereof, the above embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A stand-up type personal watereraft comprising:

a body including a hull and a deck covering the hull from above, the body having a foot deck at a rear portion of the deck, on which an operator rides;

a water jet pump configured to propel the watercraft;

a four-cycle multi-cylinder engine provided within the body and configured to drive the water jet pump, wherein the engine is disposed forward of the foot deck within the body and substantially at a center position in a longitudinal direction of the body; and a steering column that is pivotally supported on a front portion of the deck at a front end portion thereof and is configured to extend rearward in the longitudinal direction of the body;

wherein the foot deck is configured to extend from under a rear end portion of the steering column to a rear end portion of the body so as to include an axis located at a center in a lateral direction of the body so as to extend along the longitudinal direction of the body; and wherein the four-cycle multi-cylinder engine is an inline four-cylinder engine and is mounted within the body to be located under the steering column such that a crankshaft thereof extends substantially in the longitudinal direction of the body and cylinders are oriented to extend substantially in a vertical direction of the body; and wherein the engine includes a crankcase, a cylinder block located above the crankcase, a cylinder head located above the cylinder block, and an air-intake manifold and an exhaust manifold each connected to the cylinder head and extending downward from the cylinder head, through a position horizontally lateral of the cylinder block, to a position horizontally lateral of the crankcase.

2. The stand-up type personal watercraft according to claim 1, further comprising:

an oil tank configured to reserve oil that circulates within the engine, wherein the oil tank is placed on an opposite side of the exhaust manifold relative to the engine and configured to extend upward from under the crankcase along a side wall portion of the crankcase and to have a space elongated in the vertical direction of the body at a position lateral of the crankcase.

3. The stand-up type personal watercraft according to claim 2, further comprising:

an oil-collecting structure disposed at a rear portion of a bottom portion within the crankcase, and configured to collect the oil reserved in the crankcase of the engine and to deliver the oil to the oil tank.

4. A stand-up type personal watercraft comprising:

a body including a hull and a deck covering the hull from above, the body having a foot deck at a rear portion of the deck, on which an operator rides, the body being provided with a deck opening on an upper portion thereof;

a water jet pump configured to propel the watercraft; and a four-cycle multi-cylinder engine provided within the body and configured to drive the water jet pump, wherein the engine is disposed forward of the foot deck within the body and substantially at a center position in a longitudinal direction of the body, and is constructed such that a cylinder head is located above a crankcase and a cylinder head cover provided over the cylinder head protrudes from an opening face of the deck opening toward outside of the body; and a deck hood covering the deck opening, wherein the deck hood has a concave portion upwardly recessed and opposed to an upper portion of the cylinder head cover so as to accommodate the cylinder head cover therein, with the deck hood covering the deck opening, and an air flow space located laterally relative to the concave portion to allow air taken in from outside to flow therein.

5. The stand-up type personal watercraft according to claim 4, wherein the air flow space forms a water separating chamber that serves to separate water from the air taken in from outside.

6. A stand-up type personal watercraft comprising:

a body including a hull and a deck covering the hull from above, the body having a foot deck at a rear portion of the deck, on which an operator rides;

a water jet pump configured to propel the watercraft; and a four-cycle multi-cylinder engine provided within the body and configured to drive the water jet pump;

wherein the engine is disposed forward of the foot deck within the body and substantially at a center position in a longitudinal direction of the body;

a crankshaft contained within the crankcase of the engine;

a starter gear mounted on the crankshaft and configured to rotate integrally with the crankshaft by an output of a starter motor for starting the engine; and an oil pump configured to deliver oil that circulates within the engine, the oil pump being provided with a pump gear for driving the oil pump, wherein the pump gear of the oil pump is configured to mesh with the starter gear.

7. A stand-up type personal watercraft comprising:

a body including a hull and a deck covering the hull from above, the body having a foot deck at a rear portion of the deck on which an operator rides;

a water jet pump configured to propel the watercraft;

a four-cycle multi-cylinder engine provided within the body and configured to drive the water jet pump, wherein the engine is disposed forward of the foot deck within the body and substantially at a center position in a longitudinal direction of the body;

a muffler provided in an exhaust passage of the engine;

an air cleaner box provided in an air-intake passage of the engine, wherein the muffler and the air cleaner box are arranged substantially forward and rearward relative to the engine; and a steering column that is pivotally supported on a front portion of the deck at a front end portion thereof and is configured to extend rearward in the longitudinal direction of the body;

wherein the foot deck is configured to extend from under a rear end portion of the steering column to a rear end portion of the body so as to include an axis located at a center in a lateral direction of the body so as to extend along the longitudinal direction of the body; and wherein the four-cycle multi-cylinder-engine is an inline four-cylinder engine, and is mounted within the body to be located under the steering column such that a crankshaft thereof extends substantially in the longitudinal direction of the body and cylinders are oriented to extend substantially in a vertical direction of the body.

8. A stand-up type personal watercraft comprising:

a body including a hull and a deck covering the hull from above, the body having a foot deck at a rear portion of the deck, on which an operator rides;

a water jet pump configured to propel the watercraft;

a four-cycle multi-cylinder engine provided within the body and configured to drive the water jet pump, wherein the engine is disposed forward of the foot deck within the body and substantially at a center position in a longitudinal direction of the body; and two mufflers provided in an exhaust passage of the engine, wherein deck fins are provided at right and left side portions of the deck so as to protrude upward from an upper surface of the foot deck, and the mufflers are contained in the right and left deck fins, respectively.

9. The stand-up type personal watercraft according to claim 1, wherein the air-intake manifold is spaced apart from the cylinder block at the position horizontally lateral of the cylinder block, and is spaced apart from the crankcase at the position horizontally lateral of the crankcase.

10. The stand-up type personal watercraft according to claim 1, wherein the exhaust manifold is spaced apart from the cylinder block at the position horizontally lateral of the cylinder block, and is spaced apart from the crankcase at the position horizontally lateral of the crankcase.

11. The stand-up type personal watercraft according to claim 1, wherein the air-intake manifold extends downward to a position horizontally lateral of a crankshaft positioned within the crankcase.

12. The stand-up type personal watercraft according to claim 1, wherein the exhaust manifold extends downward to a position horizontally lateral of a crankshaft positioned within the crankcase.

* * * * *